US006254211B1

(12) United States Patent
Simon et al.

(10) Patent No.: US 6,254,211 B1
(45) Date of Patent: Jul. 3, 2001

(54) ADJUSTABLE RELIABILITY PARAMETERS IN INK JET PRINTING SYSTEMS

(75) Inventors: Robert J. Simon, Bellbrook; Randy D. Vandagriff, Beavercreek, both of OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/218,806

(22) Filed: Dec. 22, 1998

(51) Int. Cl.[7] ..... B41J 29/38; B41J 2/195
(52) U.S. Cl. ..... 347/6; 347/7
(58) Field of Search ..... 347/6, 7

(56) References Cited

U.S. PATENT DOCUMENTS 5,049,898 * 9/1991 Arthur et al. .
5,455,606 * 10/1995 Keeling et al. ..... 347/7
5,610,635 * 3/1997 Murray et al. ..... 347/7
5,627,572 * 5/1997 Harrington et al. ..... 347/23
5,638,097 * 6/1997 Takayanagi et al. ..... 347/7
5,736,997 * 4/1998 Bolash et al. ..... 347/19

* cited by examiner

*Primary Examiner*—John Barlow
*Assistant Examiner*—Alfred Dudding
(74) *Attorney, Agent, or Firm*—Barbara Joan Haushalter

(57) ABSTRACT

An ink jet printing system is provided, having improved reliability. To achieve the improved reliability, the ink jet printer has the capability of changing at least one reliability related parameter in accordance with data associated with an ink. Data associated with the ink relates to the value or setting of at least one parameter in the ink jet printer related to reliability of the ink jet printing system.

16 Claims, 1 Drawing Sheet

ADJUSTABLE RELIABILITY PARAMETERS IN INK JET PRINTING SYSTEMS

TECHNICAL FIELD

The present invention relates to ink jet printing and, more particularly, to means to maintain the reliability of ink jet printing systems

BACKGROUND ART

In continuous ink jet printing, ink is supplied under pressure to a manifold region that distributes the ink to a plurality of orifices, typically arranged in a linear array(s). The ink discharges from the orifices in filaments which break into droplet streams. The approach for printing with these droplet streams is to selectively charge and deflect certain drops from their normal trajectories. Graphic reproduction is accomplished by selectively charging and deflecting drops from the drop streams and depositing at least some of the drops on a print receiving medium while other of the drops strike a drop catcher device. The continuous stream ink jet printing process is described, for example, in U.S. Pat. Nos. 4,255,754; 4,698,123 and 4,751,517, the disclosures of each of which are totally incorporated herein by reference.

As ink jet printer systems grow increasingly more complex and the types, colors and variety of inks used in such systems increase, the control and configuration of the electro-mechanical systems of the ink jet printer for particular applications grows more difficult. To this end, commonly assigned, co-pending patent application Ser. No. 08/810,653, provided provision for the ink-jet printer to self configure itself to optimize the operability of the printer based on the ink used and the assembled printhead characteristics. The printer used a combination of matrices to store data specific for the ink used and data specific to the assembled printhead. These ink jet characteristics are stored in the computer memory, to be accessed for customized operation and configuration. If, for example, the operator changes the ink in the system, the operator indicates this to the computer. The ink jet characteristics stored in the computer are then accessed to optimize a whole new set of ink jet operating parameters based on the new ink. The computer, rather than the operator, causes printer timing, ink pressures, temperature compensations, and any other operating parameters to be changed to optimize the printer operation. Hence, the computer interprets the matrixed information to optimize operation of the ink jet printing system.

Such a system has been found to work effectively to allow the printer to operate with a wide variety of inks without the need for the operator to manually adjust the various operating parameters. It has been found that while this prior art did make the printer more user friendly, the printer was still deficient. While it has been well know that different inks require the use of different values for parameters related to flow out of the orifices and for drop break off to make the system operable, it had not been understood that there exist other operating parameters which affect not so much operability as reliability. As a result different inks could both be operated at their optimum operating points for operability but still have quite different reliability characteristics. These reliability characteristics include but are not limited to the effect the ink or other fluids may have on component performance, wear-out or failure.

What is needed, therefore, is a means to ensure that not only operability but reliability can be maintained at optimal levels.

SUMMARY OF THE INVENTION

This need is met by the adjustable reliability parameters according to the present invention, wherein the operating characteristics and failure modes caused by inks can be pre-determined and communicated to the print system.

In accordance with one aspect of the present invention, an improved ink jet printing system is provided, having improved reliability. To achieve the improved reliability, the ink jet printer has the capability of changing at least one reliability related parameter in accordance with data associated with an ink. Data associated with the ink relates to the value or setting of at least one parameter in the ink jet printer related to reliability of the ink jet printing system.

Accordingly, it is an advantage of the present invention that it provides improved reliability.

Other objects and advantages of the invention will be apparent from the following description, the accompanying drawing and the appended claims.

DETAILED DESCRIPTION OF THE PREFERRED EMBODIMENTS

Figure 1:
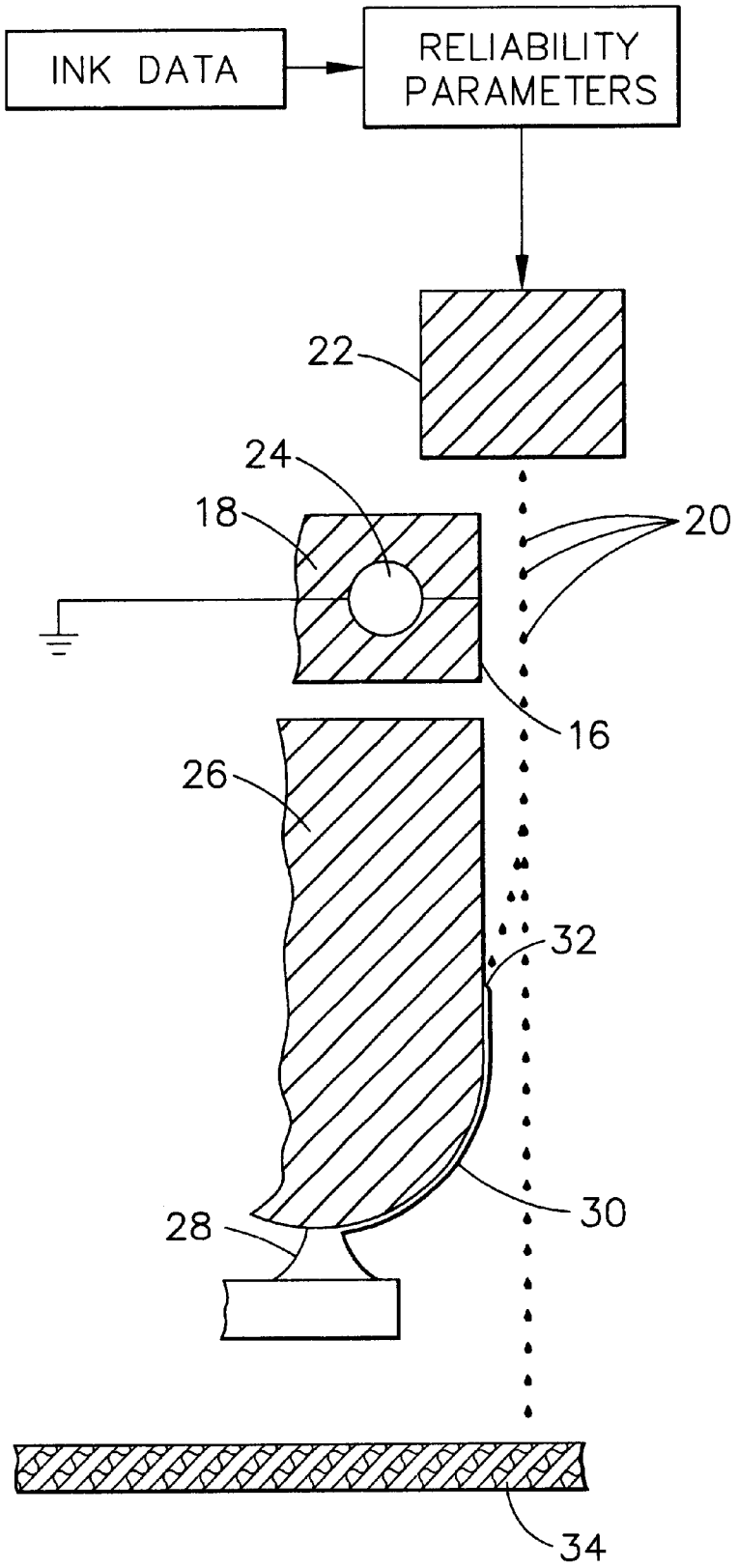
FIG. 1 is a side view of a continuous ink jet system of the type suitable for use with the adjustable reliability parameters, to result in the improved ink jet printing system with improved reliability, in accordance with the present invention.

The present invention relates to the type of continuous ink jet system illustrated in FIG. 1, with improved reliability provided by the adjustable reliability parameters of the present invention. A plurality of jets is created at high spatial resolution by a drop generator, which stimulates the natural break-up of jets into uniform streams of droplets. A plurality of conducting elements, or charge leads 16, are located on a planar charge plate 18. A plurality of streams of drops 20 are supplied by drop generator 22. A plurality of independently switchable sources 24 of electrostatic potential are supplied to the plurality of charge leads 16. A catcher 26 intercepts the slightly deflected streams of drops. The plurality of streams of drops impacting on the catcher forms a film of ink 30, which in turn forms a flow of ink 28, sucked away from the face of the catcher by a vacuum. Reference number 32 represents the area on the catcher at which the deflected drops impact the catcher and merge together to form a film of ink on the catcher face. The undeflected ink drops then print the image on substrate 34.

If during operation ink were to contact the charging electrodes, the ink can produce a shorting condition between the high voltage charging electrodes and the grounded catcher or orifice plate. Similarly, it can produce shorts between adjacent charging electrodes. Such shorts can cause permanent damage to the various printhead components. It has therefore been common practice to incorporate short detection means into the printhead. These means have typically involved means to measure the current flow to the charging electrodes or the drop in the charge voltage produced by the current load of the charge plate. During operation however, the charge voltage must be switch between the catch voltage level and the print voltage level. Such switching produces high instantaneous current levels. It has been the practice therefore to check for shorts only during selected time intervals when the charge voltage maintained at the high voltage level. It has been found however that such a short detection system can produce false indications of shorts if the detection threshold is too low. As the printer shuts down in response to detected shorts, to prevent permanent damage to components, such false shorts can improperly increase the downtime of the printer. To avoid this problem, one can lower the sensitivity of the short detection system by changing the threshold level for short detection. One can reduce the number of false shorts by requiring the monitored parameter, current or voltage drop, to exceed the threshold for some minimum amount of time before a short is indicated. This minimum amount of time that the detected parameter crosses the threshold before a short is indicated is called the short detection interval. The risk with either of these options is that the threshold level may be to high or that the short detection interval may be too long so that true short may not be detected and permanent damage may be done.

Improved means to detect shorts have been described and claimed in commonly assigned, co-pending U.S. patent application Ser. No. 09/211,206. This invention employs two distinct short detection electrodes to detect possible shorts. These two detection electrodes are located below the charging electrodes where ink could cause a charging electrode short will also produce a short between the detection electrodes. As these detection electrodes do not undergo the switching transients associated with selecting print and catch drops, the detection electronics can continuously check for shorts. While such a system is an improvement over the prior art, false indications of shorts may still be indicated. As in the prior art, the number of false shorts can be reduced by changing the detection threshold or by requiring the measured parameter to remain above the threshold for a minimum amount of time.

With the short detection systems described above, there is an optimal threshold level and detection time intervals which yields the least amount of false shorts while still providing the best sensitivity to true shorts. This optimum point provides the best balance of minimizing cost associated with downtime, due to false shorts, with minimizing the printhead repair or replacement costs. It has further been determined that the optimal levels and intervals differ from one ink type to another. These optimal parameter values, while varying significantly for the various ink, can not be readily determined and set by the operator since there is no immediate indication of a correct or an incorrect setting. In this way, they are unlike the printhead operability parameters such as pressure or stimulation amplitude. An improper stimulation amplitude can be readily detected and therefore adjusted. An improper threshold level in the short detection system is much more subtle in producing problems.

As the proper short detection parameters cannot be readily identified, it becomes necessary to carry out extensive testing on the different inks to determine the desired short detection parameters. Rather than require the user to undergo this prolonged testing, in the present invention the ink vendor supplies the parameter information. The short detection parameter values of the printer can then be adjusted in accordance with the supplied data. One convenient manner of providing the data is to incorporate such values into enhanced forms of the ink characterization matrices described and employed in commonly assigned, co-pending U.S. patent application Ser. No. 08/810,653. The enhanced ink characterization matrices would then include not only the ink runnability information but also data relevant to the short detection system. The printer must then have means such as an algorithm to read and interpret the additional data and have means to change the short detection parameters. This implies that these parameters must be selectable by software or other means rather than hard wired into the machine. With the additional data, the printer can not only set the readily detected operating parameters which control operability, such as pressure and stimulation amplitude, but also subtle parameters which affect reliability such as short detection level and time interval.

The operating latitude of ink jet printheads can be improved by heating the ink, as discussed in commonly assigned, co-pending U.S. patent application Ser. No. 09/211,204. The higher temperature ink, with its reduced viscosity, has improved flow down the catcher face, which results in wider charge voltage latitude. Since the viscosity drops steadily with increasing temperature, the charge voltage latitude tends to increase steadily with increasing temperatures. It is known, however, that above certain temperatures, the ink may be degraded. It is therefore necessary to maintain the ink below the degradation temperature. It should be noted that degradation of the ink can not be readily observed or detected during printer operation. Rather the degradation might produce a gradual increase in printhead failures or decreased printhead life. The degradation temperature for the various ink is known to vary from ink to ink. According to the present invention, information related to the degradation temperature is also supplied by the ink vendor. The printer can then be adjusted.

In ink jet printers there is an increasing need for inks which are highly waterfast and which can print on a wide variety of substrates. To achieve these ends, various chemicals such as polymers are added to the inks. The solubility of some of these ink components may depend on temperature. At lower temperatures, for example, some of the ink components may begin to agglomerate rather than stay uniformly dispersed in the fluid. Such agglomerates can affect printer reliability by clogging filters or producing crooked jets. In general, the tendency to agglomerate decreases with increasing temperature, until the ink degradation temperature is achieved. It is seen, therefore, that such inks have an optimum operating temperature for maintaining reliability. This optimum temperature, however, is known to vary from ink to ink. Again, according to the present invention, this optimum operating temperature for the ink is supplied by the ink vendor, and the machine includes means for this adjustment to be made accordingly. Without the means to operate at the optimal temperature for each ink, the user had to choose between lower printer reliability and lower quality of the printed material. The present invention allows for higher print quality and high reliability.

In addition to the reliability related parameters discussed above, other ink dependent reliability parameters exist. One such parameter relates to the compatibility of an ink of ink jet fluid to other inks and replenishment, flushing, or cleaning fluids. While some inks are quite compatible, so that ink mixtures would cause no problems, other inks may be so incompatible that significant flushing of the fluid system and printhead is need to change from one ink to the other. With the data related to ink compatibility supplied by the ink vendor, and a printer with the appropriate algorithm to use such information, a parameter may be set to cause the printer to prevent the operator from or warn the operator about mixing incompatible fluids when fluids are added.

Different inks may also have different mixing, cleaning and flushing requirements that will affect reliability. For example, some ink might require the printer to periodically cycle the pumps and valves when the printer is inactive, such as overnight or during weekends, to maintain the stability of the ink in the fluid system. Other inks may only be stable for short periods of time, requiring the ink to be removed and replaced at defined time intervals. Other inks may require periodic short printhead rinse cycle during extended times of printing. According to the present invention, inks with the required reliability data supplied and printer having the appropriate algorithms or means to read or input such reliability related data can change appropriate reliability related parameters to cause these actions to be implemented.

The invention has been described in detail with particular reference to certain preferred embodiments thereof, but it will be understood that modifications and variations can be effected within the spirit and scope of the invention.

What is claimed is:

1. An improved ink jet printing system comprising:

an ink jet printer having a printhead;

a first reliability related parameter in the ink jet printer for detection of shorts in the printhead;

an ink for use in the ink jet printer, the ink having data associated therewith relating to a value or setting of the first reliability parameter in the ink jet printer;

a second reliability related parameter in the ink let printer related to ink properties; and means associated with the ink jet printer for adjusting the second reliability related parameter in accordance with the data associated with the ink, to improve reliability of the ink jet printing system, wherein reliability data associated with a first ink is derived by comparing physical properties of the first ink to scientific analysis of chemical properties of a second ink and relation of the chemical properties to the ink jet printer.

2. An ink jet printing system as claimed in claim 1 wherein reliability data associated with a first ink is defined as similar to known data for a second ink.

3. An ink jet printing system as claimed in claim 1 wherein data associated with the ink is based upon empirical testing or empirical evidence.

4. An ink jet printing system as claimed in claim 1 wherein data associated with the ink comprises data in at least one table.

5. An ink jet printer system as claimed in claim 1 wherein the means associated with the ink jet printer for adjusting the at least one reliability related parameter comprises means for reading in data associated with the ink.

6. An ink jet printer system as claimed in claim 1 wherein the means associated with the ink jet printer for adjusting the at least one reliability related parameter comprises an algorithm.

7. An ink jet printer system as claimed in claim 1 wherein the at least one parameter related to operation of the short detection means comprises a parameter to control a threshold level of the short detection means.

8. An ink jet printer system as claimed in claim 1 wherein the at least one parameter related to operation of the short detection means comprises a parameter to control a short detection interval.

9. An ink for use in an ink jet printing system as claimed in claim 1 wherein the data associated with the ink comprises data related to operation of the short detection means in the ink jet printer.

10. An ink for use in an ink jet printing system as claimed in claim 1 wherein the data associated with the ink comprises data related to operating temperature of the ink in the ink jet printer.

11. An ink jet printer system as claimed in claim 1 wherein the at least one reliability related parameter comprises operating temperature of the ink.

12. An ink jet printer system as claimed in claim 1 wherein the at least one reliability related parameter comprises a parameter related to compatibility of ink jet fluids.

13. An ink jet printer system as claimed in claim 1 wherein the at least one reliability related parameter relates to lifetime of the ink.

14. An ink jet printer system as claimed in claim 1 wherein the at least one reliability related parameter relates to cleaning functions of the ink jet printer.

15. An ink for use in an ink jet printing system as claimed in claim 1, the ink having data related to at least one reliability related function of the ink jet printer associated with the ink.

16. An ink jet printer system as claimed in claim 1 further comprising means to change the at least one reliability related parameter for use with different inks.

* * * * *